United States Patent [19]

McSherry

[11] Patent Number: 4,620,665

[45] Date of Patent: Nov. 4, 1986

[54] CONTAINER WITH INTEGRAL TOGGLE CLOSURE

[75] Inventor: Thomas W. McSherry, Stamford, Conn.

[73] Assignee: Nathaniel H. Garfield, Harrison, N.Y. ; a part interest

[21] Appl. No.: 524,241

[22] Filed: Aug. 18, 1983

[51] Int. Cl.[4] ..... B65D 3/20; B31B 1/72

[52] U.S. Cl. ..... 229/43; 156/73.1; 229/7 R; 229/17 R; 493/157; 493/184; 493/308; 493/452

[58] Field of Search ..... 229/17 R, 17 G, 43, 229/7 R; 493/52, 308, 165, 452, 184, 157, 70, 80; 156/73.1

[56] References Cited

U.S. PATENT DOCUMENTS

| | | | |
|---|---|---|---|
| 3,083,890 | 4/1963 | Ignell . | |
| 3,107,839 | 10/1963 | Kauffeld . | |
| 3,141,597 | 7/1964 | Palmer . | |
| 3,175,749 | 3/1965 | Elias . | |
| 3,185,376 | 5/1965 | Crawford et al. . | |
| 3,204,850 | 9/1965 | Wilcox . | |
| 3,319,868 | 5/1967 | Huang et al. | 229/17 G |
| 3,327,920 | 6/1967 | Hynes et al. | 229/17 G |
| 3,349,988 | 10/1967 | Horning | 229/17 G |
| 3,351,260 | 11/1967 | Koolnis . | |
| 3,366,308 | 1/1968 | Phillips, Jr. . | |
| 3,381,874 | 5/1968 | Russo . | |
| 3,447,732 | 6/1969 | Deckys . | |
| 3,524,578 | 8/1970 | Benezra . | |
| 3,537,634 | 11/1970 | Collie . | |
| 3,543,993 | 12/1970 | Rausing . | |
| 3,543,995 | 12/1970 | Wilson . | |
| 3,552,604 | 1/1971 | Gordon . | |
| 3,554,430 | 1/1971 | MacEwen . | |
| 3,561,665 | 2/1971 | Smith . | |
| 3,580,427 | 5/1971 | Clarke . | |
| 3,672,557 | 6/1972 | Kryzanowski | 229/17 R |
| 3,692,227 | 9/1972 | Hennessey et al. . | |
| 3,733,309 | 5/1973 | Wyeth et al. . | |
| 3,743,164 | 7/1973 | Clark . | |
| 3,743,165 | 7/1973 | Hopkins . | |
| 3,745,150 | 7/1973 | Corsover . | |
| 3,762,625 | 10/1973 | Mojonnier . | |
| 3,797,726 | 3/1974 | Reil . | |
| 3,803,275 | 4/1974 | Corsover . | |
| 3,825,168 | 7/1974 | MacEwen . | |
| 3,851,813 | 12/1974 | Smith . | |
| 3,861,577 | 1/1975 | Druyts . | |
| 3,883,066 | 5/1975 | Smith . | |
| 3,924,797 | 12/1975 | Furbeck . | |
| 3,981,430 | 9/1976 | Keim . | |

(List continued on next page.)

FOREIGN PATENT DOCUMENTS

| | | | |
|---|---|---|---|
| 940485 | 10/1963 | United Kingdom . | |
| 1067602 | 5/1967 | United Kingdom | 229/17 G |

OTHER PUBLICATIONS

"The Narrowing Field of Plastics for Blow Molded Beverage Containers", by Prof. Seymour, Plastics Design & Processing, pp. 61–65 (Jun. 1977).

"Stretch-Blow Molding for Packaging Versatility", by Fredrickson, Plastics Design & Processing, pp. 22–26 (Nov. 1979).

*Primary Examiner*—William Price
*Assistant Examiner*—Bryon Gehman
*Attorney, Agent, or Firm*—Pennie & Edmonds

[57] ABSTRACT

A container defining an inner containment region and having means for positively sealing and opening at least one end to provide access to the containment region. An enclosure member is provided with at least one closure secured thereto for hinged movement adjacent to the opening, the closure being bi-directionally movable from a locked first position wherein the closure seals the container opening, through an intermediate position to a locked second position wherein the closure positively unseals the opening. The enclosure member resiliently deforms in coopertive interaction with the closure as the closure moves between the first and second positions, respectively, to aid further movement thereof from the intermediate position to either of the first locked closed positiion or the second locked open position. A method for manufacturing the container is also disclosed.

45 Claims, 21 Drawing Figures

U.S. PATENT DOCUMENTS 3,995,806 12/1976 McSherry ..... 229/17 R
3,998,380 12/1976 Kanelous ..... 229/17 R
4,184,624 1/1980 Magill ..... 229/17 G
4,185,765 1/1980 McLaren .
4,206,867 6/1980 Skjelby ..... 229/17 G
4,211,357 7/1980 Lisiecki ..... 229/17 G
4,214,697 7/1980 Manning .
4,228,898 10/1980 Zeitter et al. .
4,228,899 10/1980 Austin, Jr. .
4,244,474 1/1981 Wise ..... 229/17 G
4,245,743 1/1981 Heuberger .
4,281,787 8/1981 Hensey .
4,301,927 11/1981 Carlsson et al. .
4,307,834 12/1981 Roccaforte .
4,313,553 2/1982 Lisiecki ..... 229/17 G
4,314,642 2/1982 Dagostine .
4,327,861 5/1982 Thompson ..... 229/17 G
4,332,344 6/1982 Strodthoff ..... 229/17 G
4,343,402 8/1982 Holmstrom .
4,362,245 12/1982 Kuchenbecker .

22
26
28
30
34
36
40
12

CONTAINER WITH INTEGRAL TOGGLE CLOSURE

TECHNICAL FIELD

The present invention relates to containers which are capable of being opened and closed and particularly to containers having positive locking action closure means for sealing and opening the interior thereof.

BACKGROUND ART

The field of containers is a well-known art which has developed from ancient pottery to include the present day tamper-proof containers whose present need is evidenced by the recent difficulties encountered in maintaining the integrity of containers on store shelves. In addition, known containers include various sealing means which are either integrally formed with the body of the container or secured thereto in order to permit opening and sealing of the container. However, the fabrication of such containers has become complicated as improved seals are employed. Moreover, such seals usually require additional structure to retain the seals in a closed position. Examples of such sealing structures are found in typical milk containers as disclosed, for example, in U.S. Pat. Nos. 4,184,624; 4,206,867; 4,211,357; 4,244,474; 4,313,553; 4,314,642; and 4,327,861.

Improvements in such containers have been directed to providing simpler structured containers and closure seals which are positively locked in either opened or closed positions.

One such improvement is evidenced by U.S. Pat. No. 3,995,806 which discloses a rectangular outer configuration having an opening positioned in a side wall thereof. A hinged flap closure is secured at its periphery to the periphery of the opening. In this fashion, the hinged closure can be drawn outwardly from the side wall thereof. Such movement is made possible by virtue of the flexing of the structure forming the hinge and such flexing is required in order to permit the hinge to move from an open to a closed position or vice versa.

Similar type structures are disclosed in U.S. Pat. Nos. 3,672,557 and 3,998,380 wherein the hinge members also flex in their movement from an open to a closed position. However, in none of these patents does the container body structure flex substantially so as to contribute to the operation of the movement of the hinge structure. Moreover, the sealing of these containers is provided solely by the flex of the hinge structures. With repeated use, these structures, which are relatively small in comparison to the size of the container body, weaken and thereby diminish the sealing capability of these structures.

I have invented a improved container which avoids the aforementioned limitations and thus provides an advance over the known state of the art structures.

SUMMARY OF THE INVENTION

The present invention relates to a container provided with means for sealing and opening the interior thereof with positive locking action in either position which comprises self-enclosed resilient wall member having an inner region and at least one opening, and closure means movably secured to the wall member adjacent the opening and configured and dimensioned to provide selective sealing and unsealing of the opening in cooperation with the resilient wall member, the closure means being bi-directionally movable from a generally locked first position, wherein the closure means positively seals the opening, through an intermediate position to a generally locked second position wherein the closure means positively unseals the opening, the wall member resiliently deforming as the closure means moves between the first and second position through the intermediate position so as to aid further movement of the closure means from the intermediate position to either the second position or the first position, respectively, thus positively locking the closure means in the first closed position or the second open position, respectively.

The closure means is configured and dimensioned such that its total surface area is greater than the cross sectional area of the opening. The wall member is resiliently deformable to produce a transient distortion of the opening that permits the greater surface area to pass through the smaller cross sectional area during the movement of the closure means between the first and second positions. This resilient deformation generates forces tending to return the wall member to its undeformed configuration. The forces initially resist the movement of the closure means from the first or second positon as the deformation and distortion develop to a maximum. Thereafter, the return forces reverse their action and propel the remaining movement of the closure means to the other of the first or second positions to achieve positive locking action as the deformation and distortion dissipate and the wall member recovers its undeformed configuration.

In a preferred embodiment, the self-enclosed resilient wall member has an undeformed stable configuration and the closure means is integrally formed with the wall member. As the closure means moves between the first and second position through the intermediate position, the wall member resiliently deforms and thereby generates forces tending to return the deformed wall member to its stable configuration.

Preferably, the closure means is in the configuration of two complementary planar triangles joined together at a common junction through a flexible hinge. The balance of the material in the triangles is relatively less flexible so that movement of the closure means between the first and second portions is translated primarily into flexing at the hinge with no substantial distortion of the planes of the triangles.

In a preferred alternative embodiment according to the present invention the container comprises a self-enclosed resilient side wall member having a first end and a second end with an opening at each end. An end wall member is secured to the side wall member adjacent the second end so as to sealingly secure the second end opening. The closure means is integrally and movably secured to the side wall member adjacent the first end opening which can be selectively sealed and unsealed by the closure means in cooperation with the resilient wall member.

According to one preferred embodiment, the container is generally rectangular in cross-section and the side wall member is formed of a plurality of side wall panels joined sequentially to one another along their respective longitudinal edges. The first end opening is defined by the first end peripheral edges of the side wall panels and the second end opening is defined by the second end peripheral edges of the side wall panels. The end wall member and the securement of its peripheral edges to the second end edges of the panel members are configured and demensioned such that the side wall member can be resiliently deformed relative to the end wall member.

Preferably the closure means includes a pair of like shaped triangular panel members hingedly secured to one another along their bases and hingedly secured to the first end peripheral edges of a pair of adjacent side wall panels. The triangular panel members are configured and dimensioned such that when in a closed position their free ends are in sealing engagement with the first end peripheral edges of the remaining side wall panels. Alternatively, the sealing engagement of the free ends with the peripheral edges of the remaining side wall panels can be a friction fit relationship or the free ends and peripheral edges can be of a mating tongue and groove configuration. In yet another alternative embodiment, the triangular panel members are configured and dimensioned so as to extend beyond the first end peripheral edges of the remaining side wall panels and thus form a flange to permit the user to selectively employ the flange in aid of advancing the triangular panel members either to an open or a closed position.

The end wall member, side wall panels and the triangular panel members can be formed of a rigid material. Each of the panel members can be integrally formed of a plastic composition.

Alternatively, the side wall member can be of a cylindrical configuration. In this instance, the closure means includes a generally circular panel member hingedly attached along a portion of its peripheral edge to a portion of the peripheral edge of the first end of the side wall member. The closure means is configured and dimensioned such that the free peripheral edge of the generally circular panel member when in a closed position is in sealing engagement with the remaining portion of the first end peripheral edge of the generally circular panel member.

In yet another preferred embodiment, the container according to the present invention comprises first self-enclosed resilient side wall member defining an inner region and having an undeformed stable configuration. The side wall member has a first end and a second end with an opening at each end. The container also comprises a second self-enclosed wall member defining a second inner region and having an opening. The second wall member is secured to the first wall member adjacent the second end opening along the peripheries of their respective openings so that their respective inner regions are in communication. A closure means is integrally and movably secured to the side wall member adjacent the first end opening and is configured and dimensioned so as to provide selective sealing and unsealing of the opening in cooperation with the resilient wall member. The closure means is bi-directionally movable from a generally locked first position, wherein the closure means positively seals the first end opening, through an intermediate position to a generally locked second position wherein the closure means positively unseals the first end opening. The side wall member resiliently deforms as the closure means moves between the first and second position through the intermediate position and thereby generates forces tending to return the side wall member to its undeformed stable configuration. The return forces aid further movement of the closure means from the intermediate position to either the second position or the first position, respectively, thus positively locking the closure means in the first closed position or the second open position, respectively.

The present invention is also directed to a method for manufacturing a container provided with means for sealing and opening the interior thereof with positive locking action in either position which comprises forming a self-enclosed resilient wall member having an inner region and at least one opening, movably securing a closure means to the wall member adjacent the opening, the closure means being configured and dimensioned to provide selective sealing and unsealing of the opening in cooperation with the resilient wall member, the closure means being bi-directionally movable from a generally locked first position, wherein the closure means positively seals the opening, through an intermediate position to a generally locked second position wherein the closure means unseals the opening, the wall member resiliently deforming as the closure means moves between the first and second position through the intermediate position so as to aid further movement of the closure means from the intermediate position to either the second position or the first position, respectively, thus positively locking the closure means in the first closed position or the second open position, respectively.

According to a preferred alternative, the method comprises integrally forming a self-enclosed resilient wall member having an inner region and at least one opening, and integrally forming with the wall member a closure means movably secured to the wall member adjacent the opening.

Preferably the method includes configuring and dimensioning the closure means such that its total surface area is greater than the cross sectional area of the opening, the wall member being resiliently deformable to produce a transient distortion of the opening that permits the greater surface area to pass through the smaller cross sectional area during the movement of the closure means between the first and second positions. Also, the method includes resiliently deforming the wall member to generate forces tending to return the wall member to its undeformed configuration. The forces initially resist the movement of the closure means from the first or second position as the deformation and distortion develop to a maximum. Thereafter, the forces reverse their action and propel the remaining movement of the closure means to the other of the first or second positions to achieve positive locking action as the deformation and distortion dissipate and the wall member recovers its undeformed configuration.

It is preferred that the method includes accomplishing the integral formings in a single injection molding of plastic material. Further, the method includes frangibly sealing the free ends of the closure means to the peripheral edge of the wall member so as to provide a tamper proof container indicating, by breakage of the seal, any unauthorized use.

BRIEF DESCRIPTION OF THE DRAWINGS

The present invention is described in detail hereinbelow with particular reference to the drawings wherein.

DESCRIPTION OF THE BEST MODE OF THE INVENTION

Figure 1:
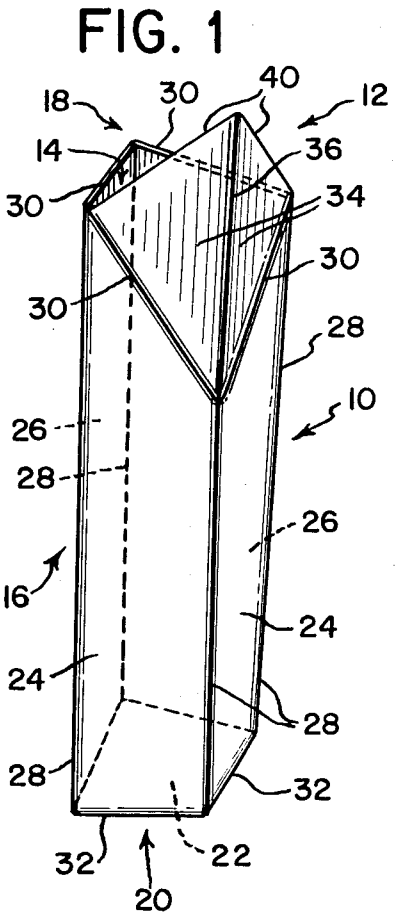
FIG. 1 is a perspective view of a preferred embodiment of a container according to the present invention wherein the closure means is in an opened configuration.

The present invention is described hereinbelow with reference to the preferred embodiments but is not intended to be limited thereto but rather is to be afforded the scope of the invention so as to include any modifications thereto as are known or obvious to those skilled in the art. In addition, any description herein below or reference with respect to orientation or direction is intended primarily for convenience in discussion and is likewise not intended to limit the scope of the present invention. Furthermore, any reference to like elements illustrated in the drawings is identified by use of like numerals.

With reference to the drawings, in FIGS. 1–4 there is illustrated a container 10 according to the present invention. The container 10 includes a closure member 12 for sealing and opening the interior 14 thereof with a positive locking action in either an opened or closed configuration. In particular, the container 10 shown in FIGS. 1 and 3 has a closure member 12 which is illustrated in an open position and in a secured or positively locked closed position in FIGS. 2 and 4.

Figure 2:
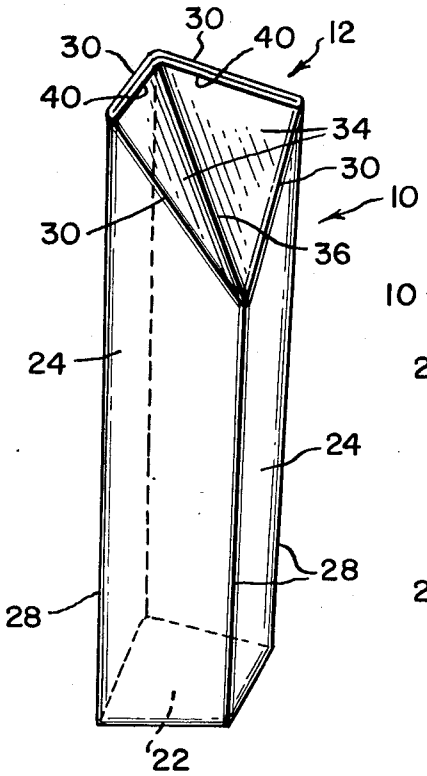
FIG. 2 is a perspective view of the container of FIG. 1 wherein the closure means is in a closed configuration.
Figure 3:
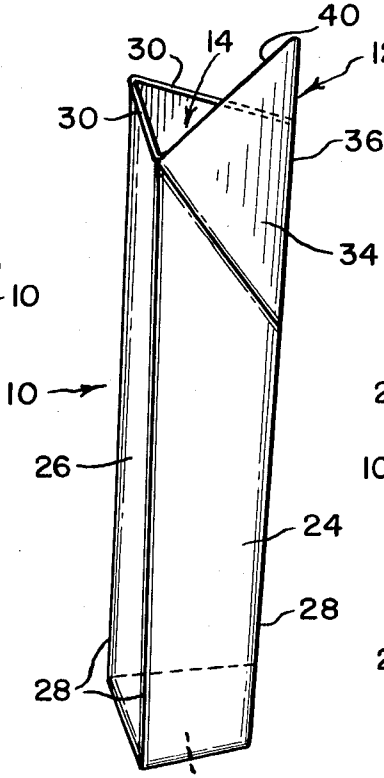
FIG. 3 is another perspective view of the container of FIG. 1.
Figure 4:
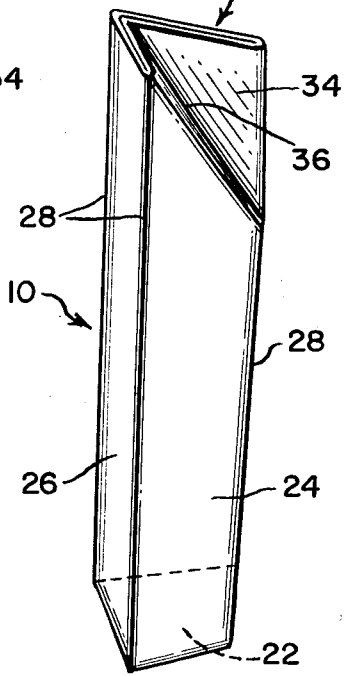
FIG. 4 is another perspective view of the container of FIG. 2.

The container 10 is formed of a side wall 16 which is self-enclosing so as to define the inner region or interior 14. The side wall member 16 is flexible and is formed so as to have an unflexed stable configuration (i.e. its undeformed condition) when the container 10 is either in the opened position as shown in FIGS. 1 and 3 or in a closed position as illustrated in FIGS. 2 and 4. The side wall member 16 has an upper end 18 and a lower end 20. The lower end is sealed by means of an end wall member 22 which has a configuration and dimension suitable for placement in the lower end opening. In the embodiment illustrated in FIGS. 1–4, the sidewall 16 is formed of a plurality of sidewall panels 24 and 26 which are sequentially joined to one another along their respective longitudinal edges 28. As shown in FIGS. 1–4, the front facing panels 24 have equal widths but are different from the equal widths of backfacing panels 26. The first end opening 18 is defined by the upper peripheral edges 30 of the panel members 24 and 26. Similarly, the lower end opening 20 is defined by the lower peripheral edges 32 of the wall panels 24 and 26. As shown in FIG. 2, the lower end wall member 22 is secured along its edges to the lower peripheral edges 32.

The closure means 12 is formed of a pair of like shaped triangular panel members 34 which are hingedly secured to one another along their bases in a hinge like seam 36. An adjacent pair of legs 38 of triangular panel members 34 are hingedly secured to a pair of peripheral adjacent edges 30 of the sidewall panels 24. The remaining legs of free ends 40 of panel members 34 are configured and dimensioned so as to sealing contact the upper peripheral edges 30 of sidewall panels 26 when the closure member 12 is in a sealed or closed position as shown in FIG. 2.

Figures 5, 6, 7, 8, 9:
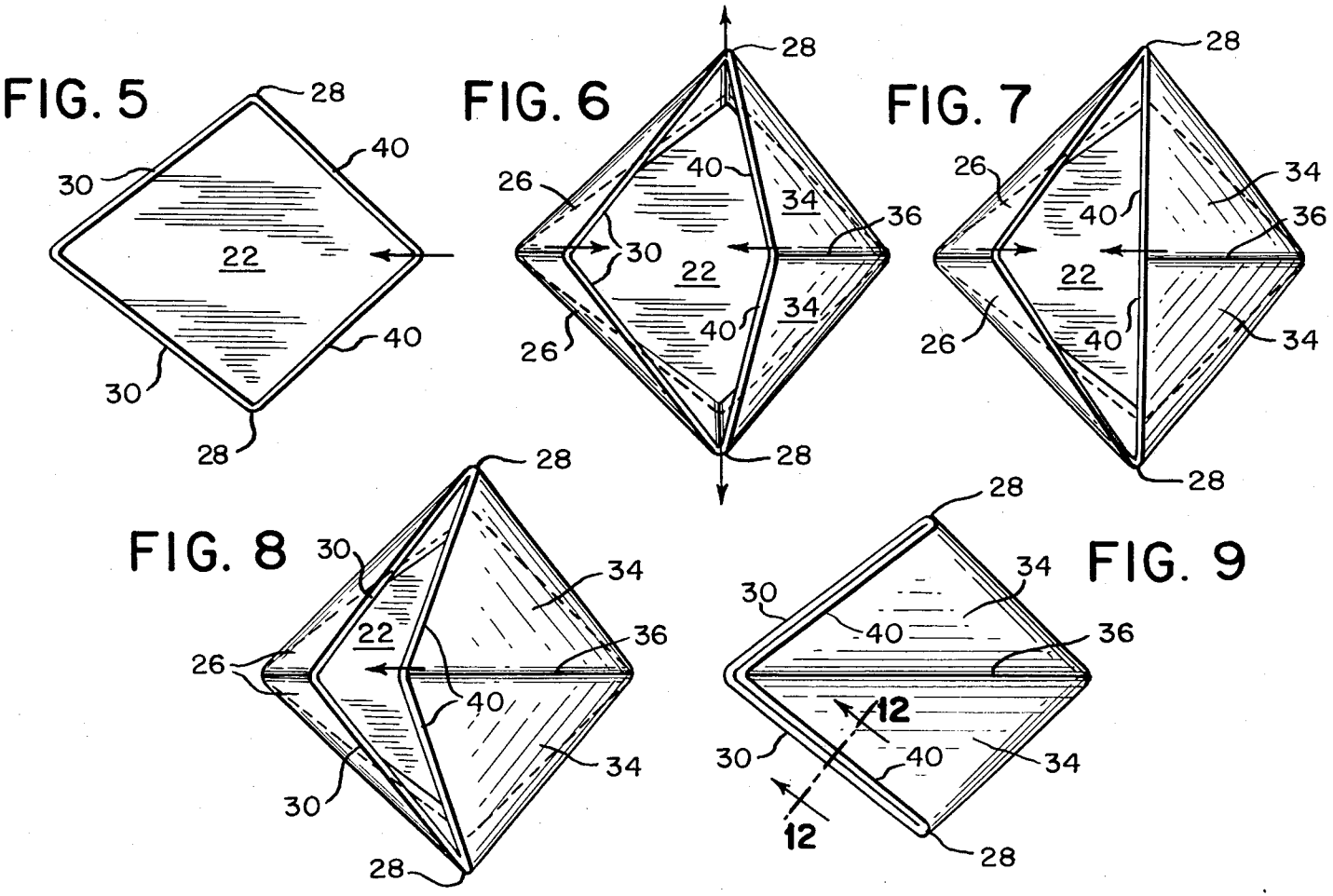
FIG. 5 is a top view of the container of FIG. 1.
FIG. 6 is a top view of the container of FIG. 1 wherein the closure means is advancing to the closed configuration.
FIG. 7 is a top view of the container of FIG. 1 wherein the closure means is passing through an intermediate configuration.
FIG. 8 is a top view of the container of FIG. 1 wherein the closure means is further advancing to the closed configuration.
FIG. 9 is a top view of the container of FIG. 2

As illustrated in FIGS. 5–9, the operation or movement of the closure member 12 is illustrated from a fully open position shown in FIG. 5 through an intermediate position shown approximately in FIG. 7 and finally to a closed position shown in FIG. 9. It should be readily apparent that any discussion with respect to the operation of the closure of the container 10 from an open position to a closed position as described and referenced to the drawings illustrated in FIGS. 5 through 9 is also applicable in respect to the operation of the opening of the container in a reverse sense. As illustrated in FIG. 5, the free ends 40 of triangular panels 34 are fully extended outwardly away from the peripheral edges 30 of panel members 26. In this position, the cross-sectional lengths of triangular panel members 34 as viewed from above is greater than the distance between opposite edges 28 as illustrated in FIG. 5 when the container is in its undeformed condition. In the process of closing or sealing the opening 18, the triangular panel members are flexed relative to the seam hinge 36 in an inward direction as indicated by the direction of the arrow indicated in FIG. 6. As the free ends 40 of triangular panel members 34 advance inwardly as shown in FIG. 6 so as to seal the opening 18, the edges 28 move away from one another and the edges 30 of sidewall panels 26 move inwardly toward free ends 40. As shown in FIG. 7, the free ends 40 finally line up linearly so that the distance between opposite edges 28 is at a maximum and the distortion of container 10 is also at a maximum. The position shown in FIG. 7 is approximately an intermediate position wherein the length between the opposite edges 28 is equal to the distance of the cross sectional lengths of sidewall members 34. It is apparent that in the process of movement from the open position in FIG. 5 to the approximate intermediate position illustrated in FIG. 7, the container is distorted from its stable or neutral configuration shown in FIG. 5 so as to produce a transient distortion of the opening 18 that permits the greater surface area as provided by the cross sectional lengths of panel members 34 to pass through the originally smaller cross sectional area determined by the distance between edges 28 during the movement of the closure member 12 from an open to a closed position or configuration. During this process, forces are generated as a result of the deformation of the container 10 beginning in FIG. 5 which forces tend to return the wall member 16 to its underformed stable configuration. These forces initially resist the movement of the closure member 12 from either an open or closed position as the deformation and distortion develop to a maximum. Thereafter, the return forces reverse their action and propel the remaining movement of the closure member 12 to the other of either of the open or the closed positions to achieve positive locking action as the deformation and distortion dissipate and the wall member recovers its undeformed configuration. This latter operation results, e.g., in the movement of the triangular panel members 34 from the approximate intermediate position illustrated in FIG. 7 to the partially closed position as shown in FIG. 8 wherein the free ends 40 of the triangular panel members 34 are advancing toward the receding edges 30. Finally, the sidewall 16 returns to its stable configuration as shown in FIG. 9 wherein the distance between edges 28 equals the same distance in FIG. 5. Also the free ends 40 are placed in a secured or tight fitting relationship with the upper peripheral edges 30 of the sidewall members 26 so as to come to rest in a closed position or configuration.

The deformation of the container 16 is provided as a result of the seam lines 28 which allow the container wall panels 24 and 26 to flex as shown, e.g., in FIGS. 6–8 relative to the edges 28 about the end wall member 22 which is securely fastened to the lower peripheral edges 32 of panel members 24 and 26. In this manner, the end wall member 22 in effect acts as a fulcrum point about which the container body 16 can deform.

By virtue of the above noted operation, the movement and securement of the closure member 12 in either a positively locked open or a positively locked closed position is aided as a result of the deformation and distortion of the container body 16 in the manner described above.

Figure 11:
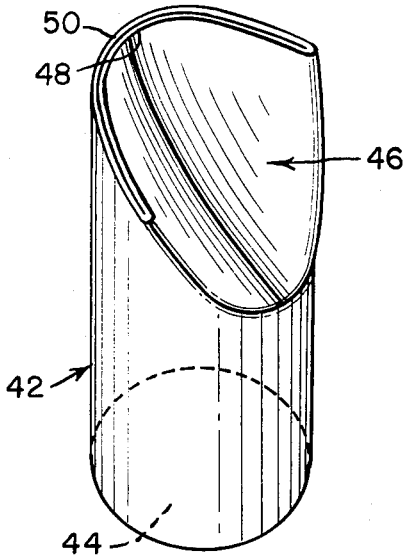
FIG. 11 is a perspective view of the container of FIG. 10 wherein the closure means is in a closed configuration.
Figure 12:
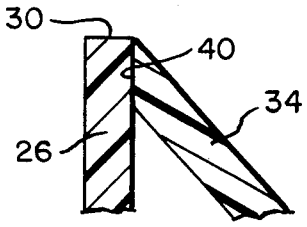
FIG. 12 is an enlarged sectional view taken along the line 12—12 of FIG. 9 illustrating the friction fit of the closure means against the container wall member.
Figure 13:
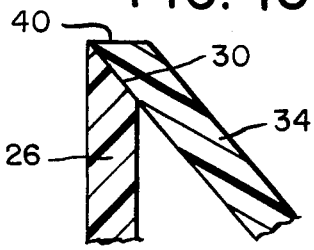
FIG. 13 is an enlarged sectional view taken along the line 12—12 of FIG. 9 illustrating a second alternative embodiment of the sealing contact between the closure means and the container wall member.

The structure of the container 10 described above can be formed by bonding the different respective panels and members together by means of bonding techniques which are well known to those skilled in the art, including but not limited to gluing and taping of same together. In addition, it is evident that upon applying plastic composition materials, the panel members can also be heat welded together as well along the respective edges. However, in a preferred embodiment, the end wall member is formed of a rigid material as are also the side wall panels 24 and 26. This would provide for the flexing of the container 10 relative to the seam lines 28 rather than in the body of the panel members themselves. Also, it is preferred that the panel members are integrally formed together with the end wall member and also the triangular panel members 34 of a plastic composition. According to this structure, the seam lines 28 can be formed by providing lines of weakning in accordance with known methods for preforming plastic containers. Preferably, the container 10 can be formed by integral injection blow molding of the container 10 from a plastic composition in accordance with the manner illustrated and described in U.S. Pat. Nos. 3,745,150 and 3,733,309 which describe the formation of containers from polyethylene terephthalate (hereinafter "PET") by use of suitable dies inserted within the bottle shape as illustrated in FIGS. 11–13 in U.S. Pat. No. 3,733,309. PET is one type of plastic composition which has found favor with the industry performing blow molded containers. Further description of other acceptable plastic compositions is provided in "The Narrowing Field of Plastics for Blow Molded Beverage Containers", by Professor Raymond B. Seymour, *Plastics Design & Processing,* pages 61–65 (June 1977). Stretch blow molding is also further described in "Stretch-Blow Molding for Packaging Versatility", by R. B. Fredrickson et al, *Plastics Design & Processing,* pages 22–26 (Nov. 1979).

Figure 10:
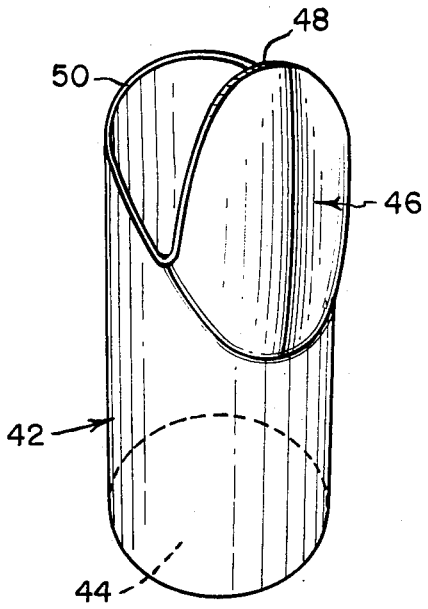
FIG. 10 is a perspective view of a second preferred embodiment of a container according to the present invention wherein the closure means is in an opened configuration.

As illustrated in FIGS. 10 and 11, the sidewall member 16 can be formed of a cylindrical member 42 which is extending upwardly from a generally circular end wall member 44. The closure member 12 is in the shape of an oval configuration so as to form an egg shaped panel members 46 having an upper free end 48 corresponding both in structure and operation to the free ends 40 and triangular panel members 34, respectively, of the embodiment illustrated in FIGS. 1–4. The free end 48 sealingly contacts the upper edge 50 of cylindrical member 42 as shown in FIG. 11 when in a closed position or configuration. In all other respects, the operation of the container 10 illustrated in FIGS. 10 and 11 is identical or similar with that described in reference to the closing and sealing of container 10 as illustrated in FIGS. 1–9.

Figure 14:
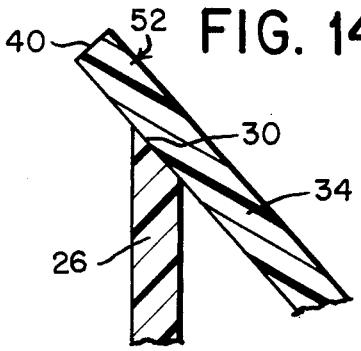
FIG. 14 illustrates yet a second alternative embodiment of the sealing contact between the closure means and the container wall member wherein the closure member extends beyond the periphery of the container wall member.
Figure 15:
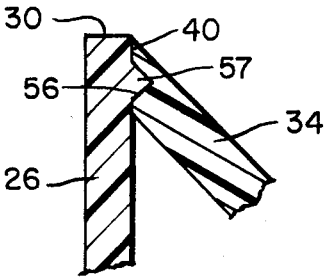
FIG. 15 is an enlarged partial view of a third alternative embodiment of the sealing contact between the closure means and the container wall member.
Figure 14A:
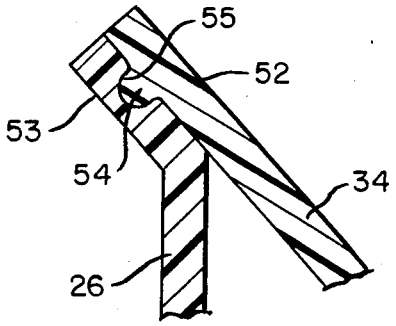
FIG. 14A illustrates an alternative embodiment of the sealing configuration of FIG. 14 wherein the closure member lies flush with a similarly angled flange extension of the container wall member.

The sealing of free ends 40 or 48 with edges 30 or 50, respectively, is shown in various preferred alternative embodiments in FIGS. 12–15. In FIG. 12, the triangular panel members 34 are shown in a friction fit type arrangement with the side wall members 26. In order to accomplish the friction type fit shown in FIG. 12, the free end 40 is shaped at an angle so as to engage the inner surface of sidewall member 26 adjacent the edge 30. As shown in FIG. 13, both the edge 30 and the free end 40 are shaped at an angle in a complementary fashion so as to be capable of coming into facing sealing engagement. In view of the fact that the container 10 of the present invention provides for a positive locking closed position thereof, it is not necessary to employ the friction type fit of FIG. 12. However, the latter is available for further securement of the closure panel members 34 against the side wall member 26. Yet another alternative preferred embodiment is illustrated in FIG. 14 wherein the triangular panel members 34 are configured so as to extend above and beyond the edge 30 of sidewall member 26. In particular, the triangular panel members 34 can extend so as to form a flange or a lip 52 which extends beyond the edge 30 of panel members 26. This lip 52 permits the user to open and close the container 10 as an aid in permitting the user to grip the lip or flange 50 with his fingertip. If desired, the sidewall member 26 can also be extended as shown in FIG. 14A at an angle to form a flange 53 upon which the flange 52 can lie flush. Moreover, a bead 54 positioned as shown in FIG. 14A cooperates with a recess or groove 55 in flange 53 so as to increase the integrity of the seal. Similarly, another alternative embodiment shown in FIG. 15 includes the provision of constructing or forming a groove 56 in the free ends 40 of triangular panel members 34 and a rib or bead 57 adjacent the upper peripheral edge 30 of panel members 26 so as to provide a bead and groove complementary structure. In this manner, the triangular panel members 34 can be guided into sealing contact with the bead 57 formed on the inner surface of sidewall member 26 adjacent the edge 30. It will be readily appreciated that the structures shown in FIGS. 12–15 are illustrative of various sealing means which may be employed as are known to those skilled in the art. In addition, it should be recognized that the orientation of the sidewall members 26 and triangular panel members 34 are not limited to the specific angular arrangements illustrated in FIGS. 12–15 but may encompass any variation of angles as desired which would necessitate various dimensioning configurations for sizes of the various panel members. Yet other alternative embodiments include the crimping (not shown) of a portion of the free ends 40 over an abutting upper edge of panel members 26 or by heat sealing the same so as to provide for a tamper proof package or container 10 which would indicate unauthorized use by the breakage of the seal. In addition, a tear strip (not shown) can also be provided to aid in the opening of an otherwise tamper proof container 10.

Figure 16:
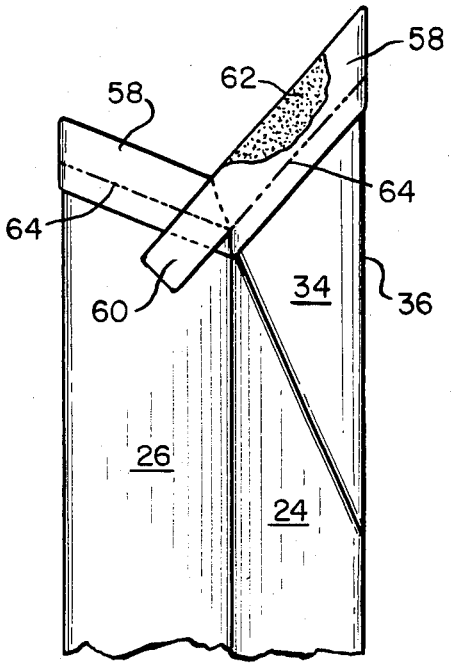
FIG. 16 is an enlarged side elevational view in part of the container of FIG. 1 illustrating a sealing closure strip positioned thereon in an opened configuration.
Figure 17:
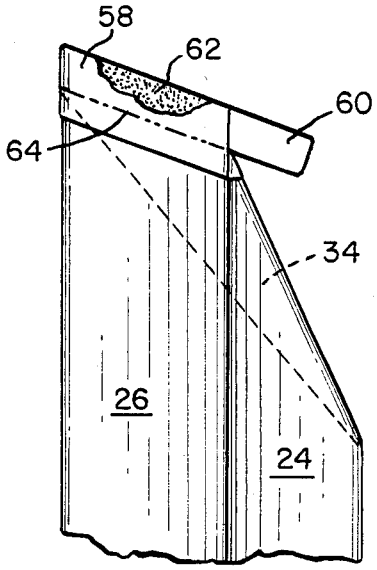
FIG. 17 is an enlarged side elevational view of the container of FIG. 16 in a closed configuration wherein the sealing closure strip is in a sealed configuration.
Figure 18:
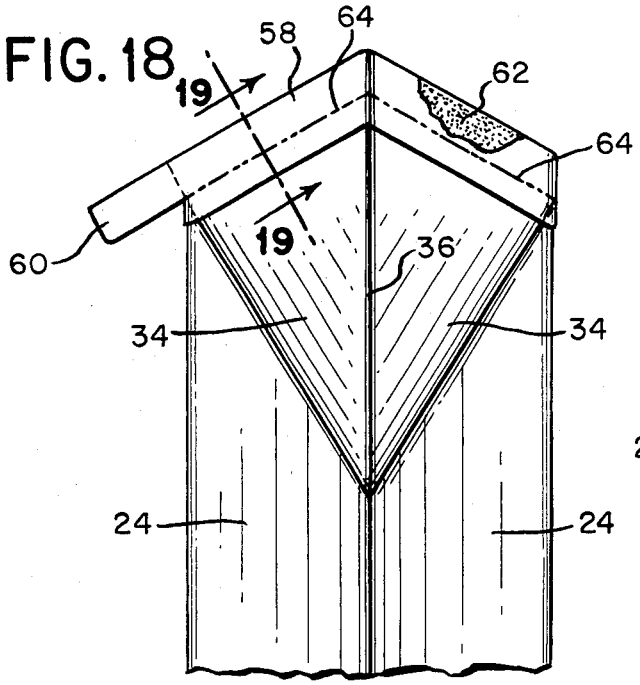
FIG. 18 is an enlarged front view of the container of FIG. 17.
Figure 19:
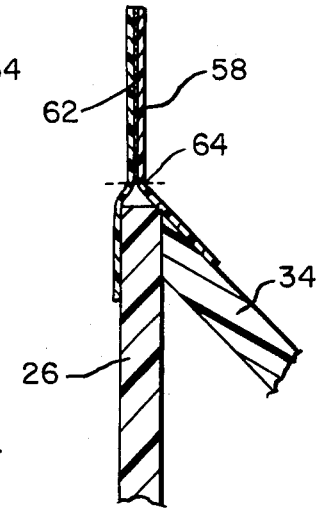
FIG. 19 is yet a further enlarged view in part taken along the lines 19—19 of FIG. 18 illustrating the adhesively combined sealing cap member.

Referring to FIG. 16, the container 10 is illustrated in a partially enlarged view as having a closure strip 58 which is secured about the outer edges of sidewall panel members 26 and the free ends 40 of triangular panel members 34. The closure strip 58 also includes a tab 60 whose purpose will be described more fully hereinbelow. In FIG. 17 the container 10 is shown in a closed configuration whereby the closure strip seals upon itself by virtue of adhesive 62 which can be applied as illustrated in the cutaway portions shown in FIGS. 16 and 17. Instead of employing such adhesive, the closure strip can be placed over the container opening 18 and thereafter sealed together either sonically or with heat into the configuration shown in FIG. 17. As shown more clearly in FIG. 18 the tab 60 extends outwardly and away from the container body 10. The closure strip 58 includes a perforation line 64 which extends completely about the length of the closure strip corresponding to the length of the free ends 40 as clearly shown in FIG. 18. By virtue of such closure strip 58, it is possible to seal the container and to provide a tamper proof package which would indicate any tampering by breakage of the perforation line 64 before authorized use. In the event that the user wishes to open the container 10, one simply grabs the tab 60 and pulls in the direction toward the seam line 36 of the closure member 12 formed between the triangular panel members 34. In this fashion the upper portion of closure strip 58 can be removed while the lower portion remains attached to the panel members 34 and the sidewall panels 26. In FIG. 19, an enlarged partial view in cross section is shown of the closure strip 58 as it is secured along its lower edges to the triangular panel members 34 and the sidewall members 26 and also indicates the adhesively secured upper portion with the perforation line 64 extending there across.

Figure 20:
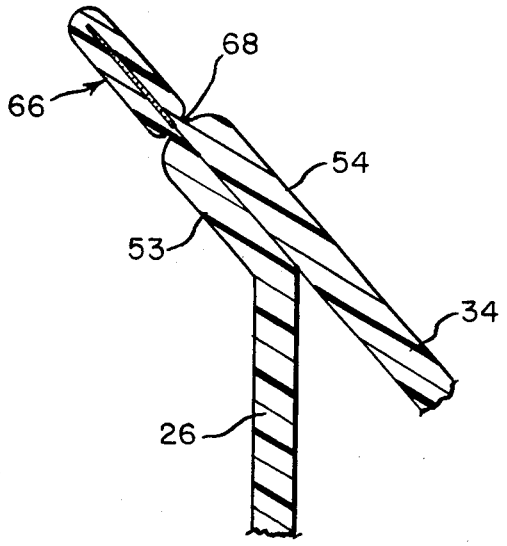
FIG. 20 is an enlarged cross-sectional view in part of an alternative embodiment of the container of FIG. 18 wherein the sealing closure strip is integrally formed with the container.

In a preferred embodiment shown in FIG. 20, the closure strip 58 can be integrally formed with the mating angled flange sealing configuration shown in FIG. 14A. The flanges 53, 54 and closure 58 are thinned down as shown in FIG. 20 to provide an integral tear strip 66 with the faces of the flanges and strip in continuous contact. The integral strip may be provided with a molded in score line 68 on one or both of its outer surfaces to facilitate tearing it away when the container is first opened. In all other respects, the embodiment illustrated in FIG. 20 is similar to that shown in FIGS. 16–19 wherefore no further discussion is believed necessary.

In another preferred erbodiment the container of the invention is comprised of a first deformable side wall member defining an inner region and having an undeformed stable configuration. The first side wall member has a first end and a second end with an opening at each end. The container also comprises a second wall member defining a second inner region and having an opening. The second wall member is secured to the first wall member adjacent to the second end opening along the peripheries of their respective openings so that their respective inner regions may be selectively placed in communication, or may be separated by a barrier partition of a known type. By the provision of such a partition therebetween, the respective inner regions may be separated from each other. Such partition may also be constructed to provide selective communication between the inner regions either by structuring it so as to be collapsible or by provision to collapse or remove a portion of the partition.

Closure means is integrally secured to the side wall member for hinged movement adjacent the first end opening and configured and dimensioned to provide selective closing and opening as described hereinabove with respect to the previous embodiments. This embodiment is not shown on the drawings.

In another preferred embodiment, the container is structured as a deformable enclosure member having a first end and a second end with an opening at each end. Each opening is of the type previously described and is provided with a closure member structured and operative as described hereinabove. Since the second end opening and the respective closure member are the same as described hereinabove, this embodiment of the invention is not shown in the drawings.

Although the present invention has been described hereinabove with reference to the drawings with respect to preferred embodiments of the present invention, it is to be recognized that the present invention is not limited to the specific structure shown herein but is to encompass as well the equivalents and modifications which would be readily apparent to those who are skilled in the art.

I claim:

1. Container provided with means for closing and opening the interior thereof with positive locking action in either position which comprises:

a. deformable enclosure member defining an inner containment region and at least one opening; and b. closure means secured to said enclosure member for hinged movement adjacent said opening and configured and dimensioned to provide selective closing and opening of said opening, said closure means being bi-directionally movable from a generally locked first position, wherein said closure means positively closes said opening, through an intermediate position to a generally locked second position wherein said closure means positively opens said opening, at least one dimension across said closure means being greatest when said closure means is in its intermediate position, said at least one dimension being greater than the corresponding dimension across said opening of said enclosure member when said enclosure member is in its undeformed condition such that said enclosure member resiliently deforms in cooperative interaction with said closure means as said closure means moves between said first and second positions through said intermediate position so as to aid further movement of said closure means from said intermediate position to either said second position or said first position, respectively, thus positively locking said closure means in said first closed position or positively opening said closure means in said second open position, respectively.

2. Container according to claim 1 wherein said closure means is configured and dimensioned such that its surface area is greater than the cross-sectional area of the corresponding portion of said opening, said enclosure member being resiliently deformable to produce a transient distortion of said opening that permits said greater surface area to pass through said smaller cross-sectional area during the movement of said closure means between said first and second positions.

3. Container according to claim 2 wherein said resilient deformation generates forces tending to return said wall member to its undeformed configuration, said forces initially resisting the movement of said closure means from said first or second position as said deformation and distortion develop to a maximum and, thereafter, said return forces propelling the remaining movement of said closure means to the other of said first or second positions to achieve positive locking action as said deformation and distortion dissipate and said wall member recovers its undeformed configuration.

4. Container provided with means for closing and opening the interior thereof with positive locking action in either position which comprises:

a. deformable enclosure member having an undeformed stable configuration and defining an inner containment region and at least one opening; and b. closure means integrally formed with said enclosure member adjacent said opening and configured and dimensioned to provide selective closing and opening of said opening, said closure means being bi-directionally movable from a generally locked first position, wherein said closure means positively closes said opening, through an intermediate position to a generally locked second position wherein said closure means positively opens said opening, at least one dimension across said closure means being greatest when said closure means is in its intermediate position, said at least one dimension being greater than the corresponding dimension across said opening of said enclosure member when said enclosure member is in its undeformed condition such that said enclosure member resiliently deforms in cooperative interaction with said closure means as said closure means moves between said first and second positions through said intermediate position and thereby generates forces which tend to return said deformed enclosure member to its stable configuration so as to aid further movement of said closure means from said intermediate position to either said second position or said first position, respectively, thus positively locking said closure means in said first closed position or positively opening said closure means in said second open position, respectively.

5. Container according to claim 4 wherein said closure means is configured and dimensioned such that its total surface area is greater than the cross sectional area of said opening so as to sealingly engage said enclosure member, said enclosure member being resiliently deformable to produce a transient distortion of said opening that permits said greater surface area to pass through said smaller cross sectional area during the movement of said closure means between said first and second positions.

6. Container according to claim 5 wherein said resilient deformation generates forces tending to return said enclosure member to its undeformed stable configuration, said forces initially resisting the movement of said closure means from said first or second position as said deformation and distortion develop to a maximum and, thereafter, said return forces propelling the remaining movement of said closure means to the other of said first or second positions to achieve positive locking action as said deformation and distortion dissipate and said enclosures member recovers its undeformed configuration.

7. Container according to claim 6 wherein said closure means is in the configuration of two complementary planar triangles joined together at a common junction through a flexible hinge, the balance of the material in the triangles being relatively less flexible so that movement of said closure means between said first and second portions is translated primarily into flexing at said hinge with no substantial distortion of the planes of said triangles.

8. Container provided with means for closing and opening the interior thereof with positive locking action in either position which comprises:

a. side wall member defining an inner containment region and having an undeformed stable configuration, said side wall member having a first end and a second end with an opening at each end;

b. an end wall member secured to said side wall member adjacent said second end so as to close and secure said second end opening; and c. closure means integrally secured to said side wall member adjacent said first end opening and configured and dimensioned to provide selective closing and opening of said opening, said closure means being bi-directionally movable from a generally locked first position, wherein said closure means positively closes said first end opening, through an intermediate position to a generally locked second position wherein said closure means positively opens said first end opening, at least one dimension across said closure means being greatest when said closure means is in its intermediate position, said at least one dimension being greater than the corresponding dimension across said opening of said enclosure member when said enclosure member is in its undeformed stable configuration such that said side wall member resiliently deforms in cooperative interaction with said side wall member as said closure means moves between said first and second positions through said intermediate position and thereby generates forces which tend to return said side wall member to its undeformed stable configuration, said return forces aiding further movement of said closure means from said intermediate position to either said second position or said first position, respectively, thus positively locking said closure means in said first closed position or said second open position, respectively.

9. Container according to claim 8 wherein said closure means is configured and dimensioned such that its surface area is greater than the cross-sectional area of the corresponding portion of said first end opening, said enclosure member being resiliently deformable to produce a transient distortion of said opening that permits said greater surface area to pass through said smaller cross-sectional area during the movement of said closure means between said first and second positions.

10. Container according to claim 9 wherein said resilient deformation generates forces tending to return said wall side member to its undeformed stable configuration, said forces initially resisting the movement of said closure means from said first or second position as said deformation and distortion develop to a maximum and, thereafter, said forces propelling the remaining movement of said closure means to the other of said first or second positions to achieve positive locking action as said deformation and distortion dissipate and said wall side member recovers its undeformed configuration.

11. The container according to claim 10 wherein said side wall member is generally rectangular in cross-section.

12. The container according to claim 11 wherein said side wall member is formed of a plurality of side wall panels joined sequentially to one another along their respective longitudinal edges, said first end opening being defined by the first end peripheral edges of said side wall panels and said second end opening being defined by the second end peripheral edges of said side wall panels.

13. The container according to claim 12 wherein said end wall member and the securement of its peripheral edges to the second end edges of said panel members are configured and demensioned such that said side wall member can be resiliently deformed relative to said end wall member.

14. The container according to claim 13 wherein said closure means includes a pair of like shaped triangular panel members hingedly secured to one another along their bases and hingedly secured to the first end peripheral edges of a pair of adjacent side wall panels and being configured and dimensioned such that the free ends of said triangular panel members when in a closed position are in sealing engagement with the first end peripheral edges of said remaining side wall panels.

15. The container according to claim 14 wherein said free ends of said triangular panel members sealingly engage the peripheral edges of said remaining side wall panels in a friction fit relationship.

16. The container according to claim 14 wherein said free ends and said peripheral edges of said remaining side wall panels are of a mating bead and groove configuration.

17. The container according to claim 14 wherein said triangular panel members are configured and dimensioned so as to extend beyond the first end peripheral edges of said remaining side wall panels and thus form a flange to permit the user to selectively employ said flange in aid of advancing said triangular panel members either to an open or a closed position.

18. The container according to claim 14 further including a closure strip which is secured about said free ends and said peripheral edges of said remaining side wall panels, said closure strip including a perforation line which extends along the length of said closure strip so as to permit frangible tearing of said closure strip and thus provide a tamper proof container indicating, by breakage of the seal, any unauthorized use.

19. The container according to claim 18 wherein said closure strip is integrally formed with said triangular panel members and said remaining side wall panels.

20. The container according to claim 14 wherein said end wall member is formed of a rigid material.

21. The container according to claim 20 wherein said side wall panels are each formed of a rigid material.

22. The container according to claim 21 wherein said triangular panel members are each formed of a rigid material.

23. The container according to claim 20 wherein said panel members are integrally formed of a plastic composition.

24. The container according to claim 10 wherein said side wall member is of a cylindrical configuration.

25. The container according to claim 24 wherein said end wall member and the securement of its peripheral edge to the second end edge of said side wall member are configured and dimensioned such that said side wall member can be resiliently deformed relative to said end wall member.

26. The container according to claim 25 wherein said closure means includes a generally circular panel member hingedly attached along a portion of its peripheral edge to a portion of the peripheral edge of the first end of said side wall member and being configured and dimensioned such that the free peripheral edge of said generally circular panel member when in a closed position is in sealing engagement with the remaining portion of the first end peripheral edge of said side wall member.

27. The container according to claim 26 wherein said free peripheral edge sealingly engages the peripheral edge of the first end of said side wall member in a friction-fit relationship.

28. The container according to claim 26 wherein said free peripheral edge and said peripheral edge of the first end of said side wall member are of a mating bead and groove configuration.

29. The container according to claim 26 wherein said generally circular panel member is configured and dimensioned so as to extend beyond the first end peripheral edge of said side wall member and thus form a flange to permit the user to selectively employ said flange in aid of advancing said generally circular panel member either to an open or closed position.

30. The container according to claim 26 further including a closure strip which is secured about said free peripheral edge and said remaining portion of the first end peripheral edge of said side wall member, said closure strip including a perforation line which extends along the length of said closure strip so as to permit frangible tearing of said closure strip and thus provide a tamper proof container indicating, by breakage of the seal, any unauthorized use.

31. The container according to claim 30 wherein said closure strip is integrally formed with said generally circular panel member and said remaining portion of the first end peripheral edge of said side wall member.

32. The container according to claim 26 wherein said generally circular panel member and said end wall member are each formed of a rigid material.

33. The container according to claim 32 wherein said side wall member, said end wall and generally circular panel members are integrally formed of a plastic composition.

34. Container provided with means for closing and opening the interior thereof comprising:

a. first side wall member defining an inner region and having an undeformed stable configuration, said side wall member having a first end and a second end with an opening at each end;

b. second wall member defining a second inner region and having an opening, said second wall member being secured to said first wall member adjacent said second end opening along the peripheries of their respective openings so that their respective inner regions may be selectively placed in communication; and c. closure means integrally secured to said side wall member for movement adjacent said first end opening and configured and dimensioned to provide selective closing and opening of said opening, said closure means being bi-directionally movable from a generally locked first position, wherein said closure means positively closes said first end opening, through an intermediate position to a generally locked second position wherein said closure means positively opens said first end opening, at least one dimension across said closure means being greatest when said closure means is in its intermediate position, said at least one dimension being greater than the corresponding dimension across said opening of said enclosure member when said enclosure member is in its undeformed condition such that said side wall member resiliently deforms in cooperative interaction with said first resilient wall member as said closure means moves between said first and second positions through said intermediate position and thereby generates forces which tend to return said side wall member to its undeformed stable configuration, said return forces aiding further movement of said closure means from said intermediate position to either said second position or said first position, respectively, thus positively locking said closure means in said first closed position or positively opening said closure means in said second open position, respectively.

35. The container according to claim 34 wherein said second wall member is of a relatively more rigid construction than said first wall member.

36. Method for manufacturing a container provided with means for closing and opening the interior thereof with positive locking action in either position which comprises:

a. forming a deformable enclosure member defining an inner region and at least one opening;

b. providing closure means secured to said enclosure member for hinged movement adjacent said opening, said closure means being configured and dimensioned to provide selective closing and opening of said opening, said closure means being bi-directionally movable from a generally locked first position, wherein said closure means positively closes said opening, through an intermediate position to a generally locked second position wherein said closure means positively opens said opening, at least one dimension across said closure means being greatest when said closure means is in its intermediate position, said at least one dimension being greater than the corresponding dimension across said opening of said enclosure member when said enclosure member is in its undeformed condition such that said enclosure member resiliently deforms in cooperative interaction with said closure means as said closure means moves between said first and second positions through said intermediate position so as to aid further movement of said closure means from said intermediate position to either said second position or said first position, respectively, thus positively locking said closure means in said first closed position or positively unlocking said closure means in said open position, respectively.

37. Method for manufacturing an integral container provided with means for closing and opening the interior thereof with positive locking action in either position which comprises:

a. integrally forming a self-enclosed enclosure member defining an inner region and at least one opening; and b. integrally forming with said enclosure member closure means secured for hinged movement to said enclosure member adjacent said opening, said closure means being configured and dimensioned to provide selective closing and opening of said opening, said closure means being bidirectionally movable from a generally locked first position, wherein said closure means positively closes said opening, through an intermediate position to a generally locked second position wherein said closure means positively opens said opening, at least one dimension across said closure means being greatest when said closure means is in its intermediate position, said at least one dimension being greater than the corresponding dimension across said opening of said enclosure member when said enclosure member is in its undeformed condition such that said enclosure member resiliently deforms in cooperative interaction with said closure means as said closure means moves between said first and second positions through said intermediate position so as to aid further movement of said closure means from said intermediate position to either said second position or said first position, respectively, thus positively locking said closure means in said first closed position or positively opening said closure means in said second open position, respectively.

38. Method according to claim 37 which includes configuring and dimensioning said closure means such that its total surface area is greater than the cross sectional area of said opening, said wall member being resiliently deformable to produce a transient distortion of said opening which permits said greater surface area to pass through said smaller cross sectional area during the movement of said closure means between said first and second positions.

39. Method according to claim 38 which includes configuring and dimensioning said enclosure member so as to be resiliently deformed to generate forces tending to return said enclosure member to its undeformed configuration, said forces initially resisting the movement of said closure means from said first or second position as said deformation and distortion develop to a maximum and, thereafter, said forces propelling the remaining movement of said closure means to the other of said first or second positions to achieve positive locking sealing action as said deformation and distortion dissipate and said wall member recovers its undeformed configuration.

40. Method according to claim 37 which includes accomplishing said integral formings in a single injection molding of plastic material.

41. Method according to claim 37 which includes forming said closure means as a pair of like shaped triangular panel members hingedly secured to one another along their bases and hingedly secured to a portion of the peripheral edge of said opening of said wall member and being configured and dimensioned such that the free ends of said triangular panel members when in a closed position are in sealing engagement with the remaining portion of the peripheral edge of said wall member.

42. Method according to claim 41 which includes frangibly sealing said free ends of said triangular panel members to said remaining portion of the peripheral edge of said wall member so as to provide a tamper proof container indicating, by breakage of the seal, any unauthorized use.

43. Method according to claim 42 wherein said frangible sealing is accomplished by heat sealing said free ends and said remaining portion of the peripheral edge of said wall member.

44. Method according to claim 42 wherein said frangible sealing is accomplished by sonically sealing said free ends and said remaining portion of the peripheral edge of said wall member.

45. Container provided with means for closing and opening the interior thereof with positive locking action in either position which comprises:

a. deformable enclosure member defining an inner containment region, said enclosure member having a first end and a seocnd end with at least one opening at each end; and b. closure means secured to said enclosure member for hinged movement adjacent each said opening and configured and dimensioned to provide selective closing and opening of each said opening, each said closure means being bidirectionally movable from a generally locked first position, wherein said closure means positively closes each said opening, through an intermediate position to a generally locked second position wherein each said closure means positively opens each said opening, at least one dimension across each said closure means being greatest when said closure means is in its intermediate position, said at least one dimension being greater than the corresponding dimension across said respective opening of said enclosure member when said enclosure member is in its undeformed condition such that said enclosure member resiliently deforms in respective cooperative interaction with each said closure means as said respective closure means moves between said first and second positions through said intermediate position so as to aid further movement of said closure means from said intermediate position to either said second position or said first position, respectively, thus positively locking each said closure means in said first closed position or positively opening each said closure means in said second open position, respectively.

* * * * *